US007031487B2

(12) United States Patent
Stiles

(10) Patent No.: US 7,031,487 B2
(45) Date of Patent: Apr. 18, 2006

(54) TABBED SPEAKER FRAME WITH OVERSIZED DIAPHRAGM

(75) Inventor: Enrique M. Stiles, Imperial Beach, CA (US)

(73) Assignee: STEP Technologies, Inc., Minneapolis, MN (US)

( * ) Notice: Subject to any disclaimer, the term of this patent is extended or adjusted under 35 U.S.C. 154(b) by 206 days.

(21) Appl. No.: 10/437,742

(22) Filed: May 14, 2003

(65) Prior Publication Data

US 2004/0228500 A1 Nov. 18, 2004

(51) Int. Cl.
*H04R 25/00* (2006.01)

(52) U.S. Cl. ..... 381/398; 381/386; 381/423; 381/433

(58) Field of Classification Search ..... 381/386, 381/391, 396, 398, 189, 423, 432, 433, 182, 381/186; 181/171, 172, 173
See application file for complete search history.

(56) References Cited

U.S. PATENT DOCUMENTS 3,684,052 A * 8/1972 Sotome ..... 381/398
6,568,503 B1 * 5/2003 Proni ..... 181/172
2003/0047377 A1 * 3/2003 Proni ..... 181/172
2004/0086143 A1 * 5/2004 Espiritu ..... 381/398

* cited by examiner

*Primary Examiner*—Huyen Le
(74) *Attorney, Agent, or Firm*—Richard Calderwood

(57) ABSTRACT

An acoustical transducer such as an audio loudspeaker or a microphone, having a suspension component whose outermost edge extends axially rather than radially and couples with an axial mounting surface in the transducer's frame rather than with a radial flat surface of the frame. The suspension component may be a surround or a spider. Eliminating the radial portions of the suspension component and the frame enables the use of a larger diaphragm within a transducer of unchanged outer dimensions, increasing the amount of air moved by or moving the diaphragm. It also enables closer on-center packing of multiple transducers onto the same baffle such as the front baffle of a speaker enclosure, or, put another way, it enables a higher percentage of the mounting baffle's front surface area to be covered with moving diaphragm area. Radial mounting flanges and their mounting holes are limited to portions of the frame which will not increase the gap space between adjacent transducers or other boundaries. The angled corner tabs of a square or hexagonal frame housing a round diaphragm would occupy the baffle surface area that would otherwise be unutilized with circular-frame speakers.

22 Claims, 9 Drawing Sheets

FIG. 1 - prior art

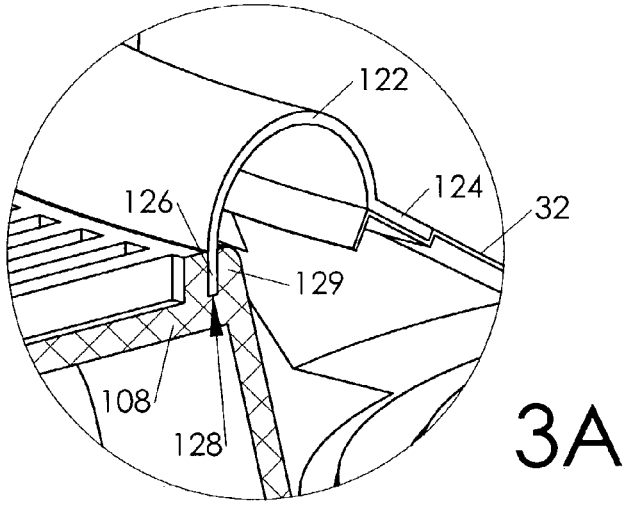
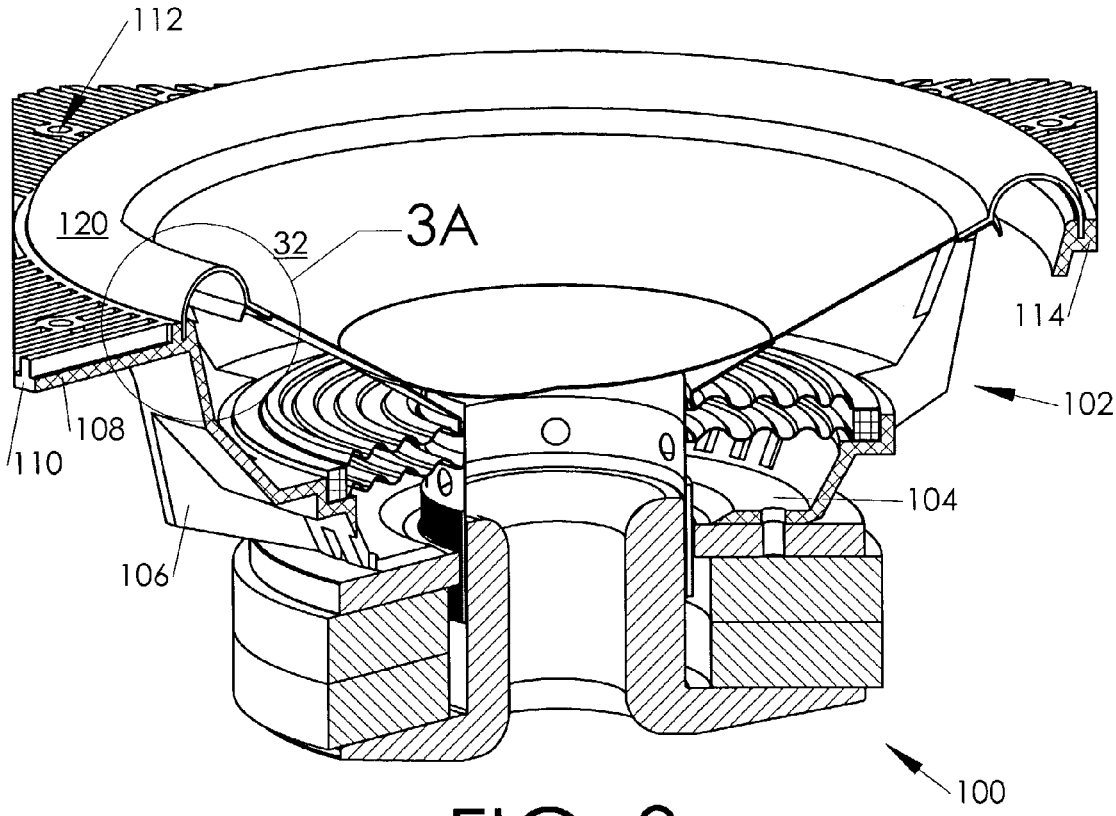
FIG. 3

100

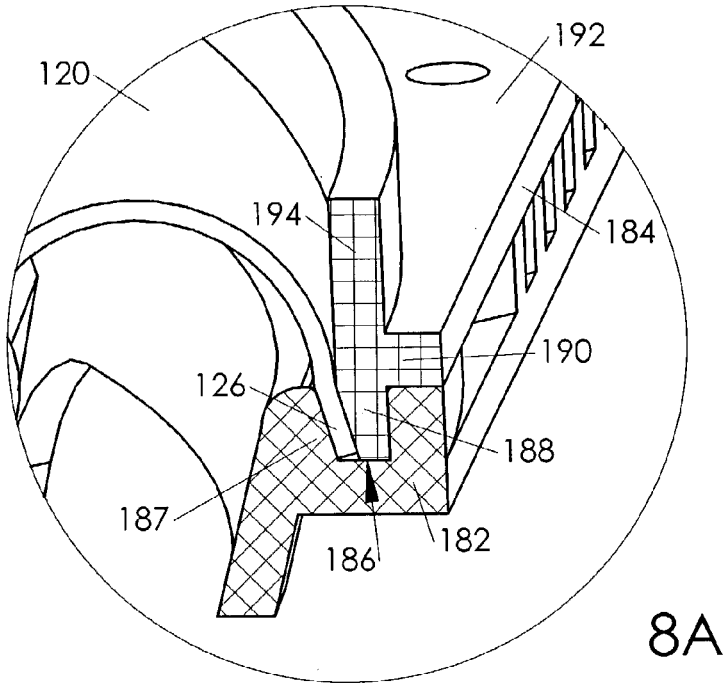
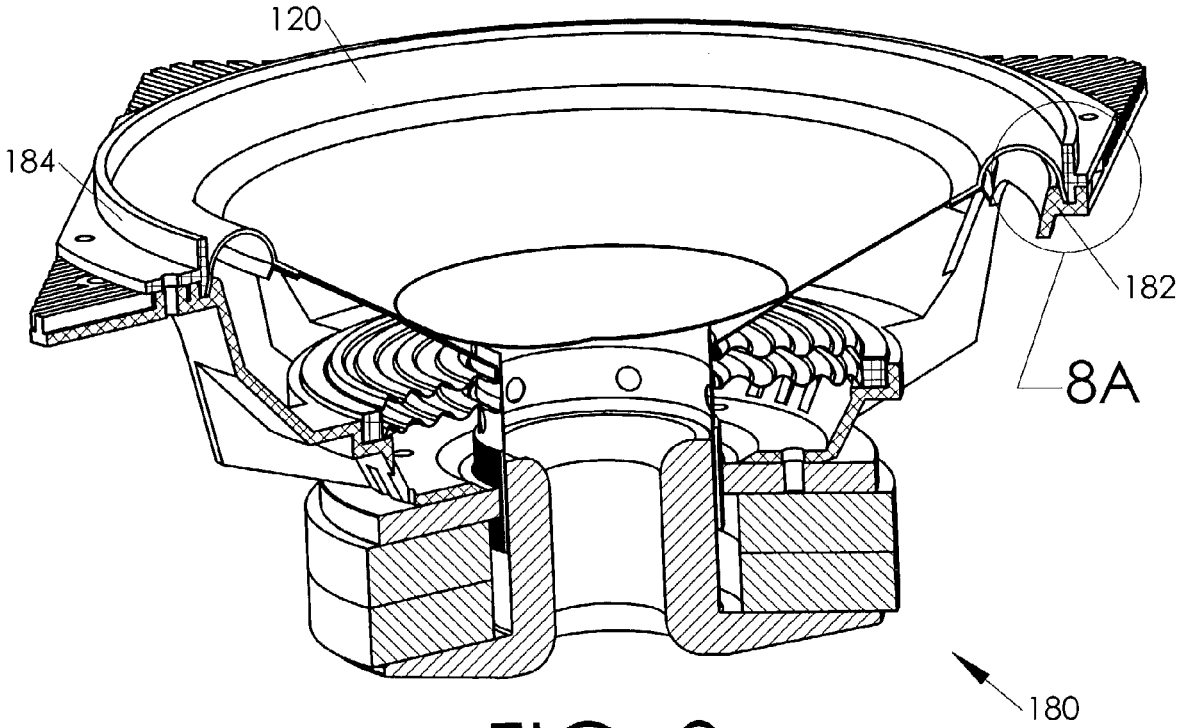
FIG. 8

TABBED SPEAKER FRAME WITH OVERSIZED DIAPHRAGM

BACKGROUND OF THE INVENTION

1. Technical Field of the Invention

This invention relates generally to electromagnetic transducers such as audio speakers, and more specifically to an improved frame and surround suspension configuration for such.

2. Background Art

FIG. 1 illustrates a conventional speaker 10 with an external magnet geometry motor structure 12 driving a diaphragm assembly 14. The motor structure includes a pole plate 16 style yoke, made of soft magnetic material and including a back plate 18 and a pole piece 20 that are either magnetically coupled or of integral construction. The pole plate may optionally include a ventilation hole 22 for depressurizing the diaphragm assembly. One or more external ring hard magnets 24 are magnetically coupled to the back plate. A top plate 26 of soft magnetic material is magnetically coupled to the hard magnets. A magnetic air gap 28 is formed between the top plate and the pole piece.

A frame or basket 30 is mechanically coupled to the motor assembly to support the diaphragm assembly. A diaphragm 32, sometimes referred to as a cone, is coupled to the basket by a flexible suspension component known as a surround 34. A voice coil former or bobbin 36 is mechanically coupled to the diaphragm, and is coupled to the basket by a flexible suspension component known as a spider 38. The surround and spider allow the bobbin and diaphragm to move axially with respect to the motor structure, but prevent, as much as possible, their lateral movement and rocking. An electrically conductive voice coil 40 is wound around and mechanically coupled to the bobbin, and is disposed within the magnetic air gap of the motor structure. A dust cap 42 is coupled to the diaphragm to seal the open end of the bobbin.

As illustrated in the detail view 1A, the surround includes a middle portion 44 such as a half-roll of flexible rubber, which provides the flexible suspension function of the surround. The surround also includes an inner portion 46 which is glued or otherwise coupled to the diaphragm 32, and an outer portion 48 which is glued or otherwise coupled to the frame 30. More specifically, the outer portion 48 of the surround extends radially outward, perpendicular to the axis of the speaker's motor structure, and is coupled to a similarly outward-extending flange 50 of the frame. The flange has a dimension sufficient to not only provide a large gluing surface for the surround, but also to accommodate the various mounting holes 52 which are used to couple the speaker basket to a baffle such as the front of an enclosure or a wall.

The suspending middle portion of the surround is not necessarily in the shape of a half-roll, but can be any suitable shape.

FIG. 2 illustrates that having these radially-extending components around the entire perimeter of the speaker limits the size of the diaphragm relative to the total outer dimension of the speaker, and limits the designer's ability to pack the diaphragms of multiple speakers in close proximity to each other on a common baffle. As shown in detail 2A, there is a considerable distance from the effective outer perimeter of one speaker's diaphragm 32*a* to the effective outer perimeter of the adjacent speaker's diaphragm 32*b*, because of the radially-extending outer surround components 46*a* and 46*b*, and because of the radially-extending frame flanges 50*a* and 50*b*, especially as the flanges must be wide enough to encompass the mounting holes.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 3 shows, in perspective view with a partial cutaway and a detail view, one embodiment of a speaker having the improved surround and frame of this invention.

FIG. 8 shows, in perspective with a detail view, another speaker according to this invention with a hold-down ring for the surround.

DETAILED DESCRIPTION

Figure 1:
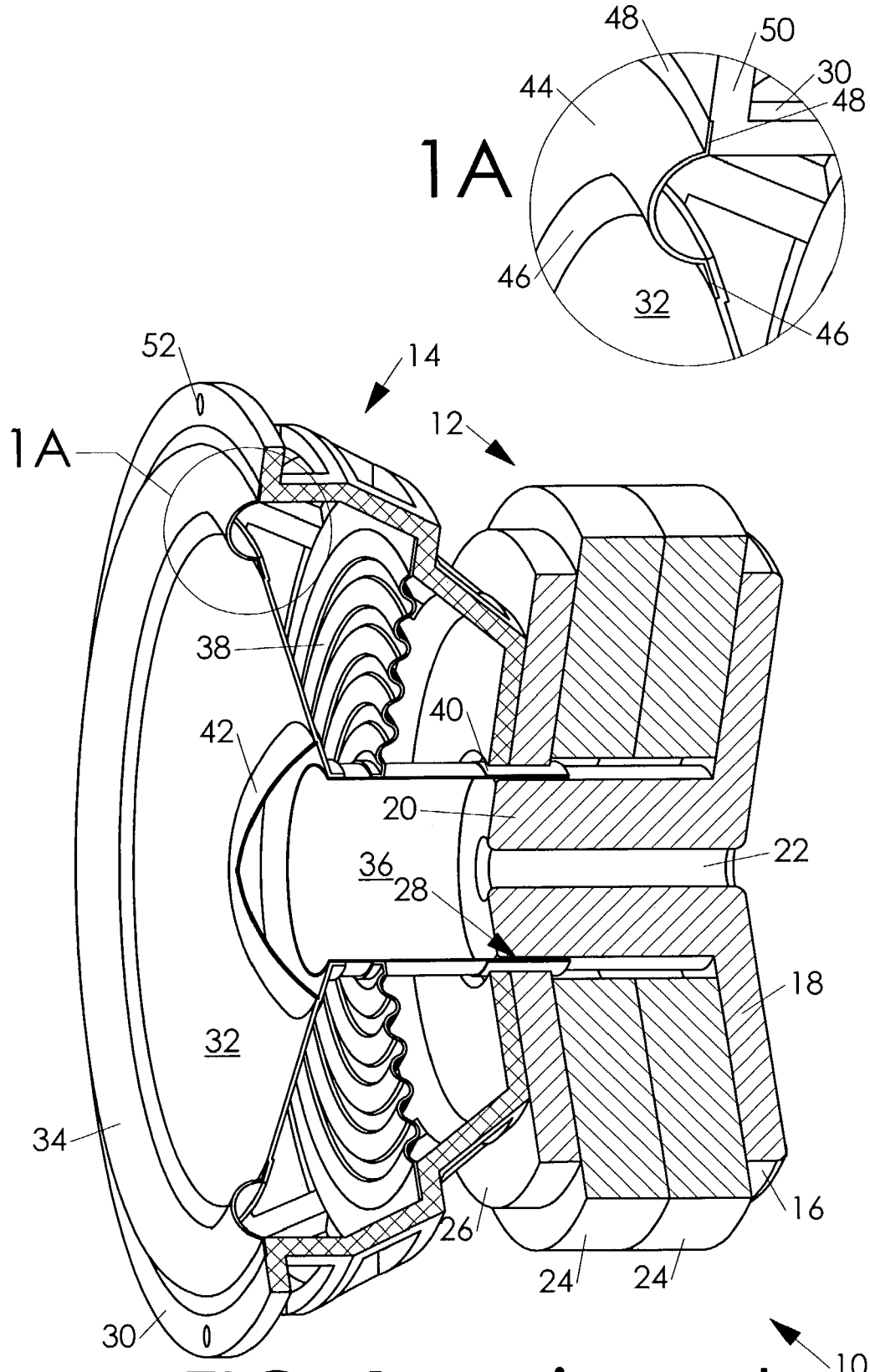
FIG. 1 shows, in perspective view with a partial cutaway and a detail view, a conventional external magnet geometry speaker according to the prior art.
Figure 2:
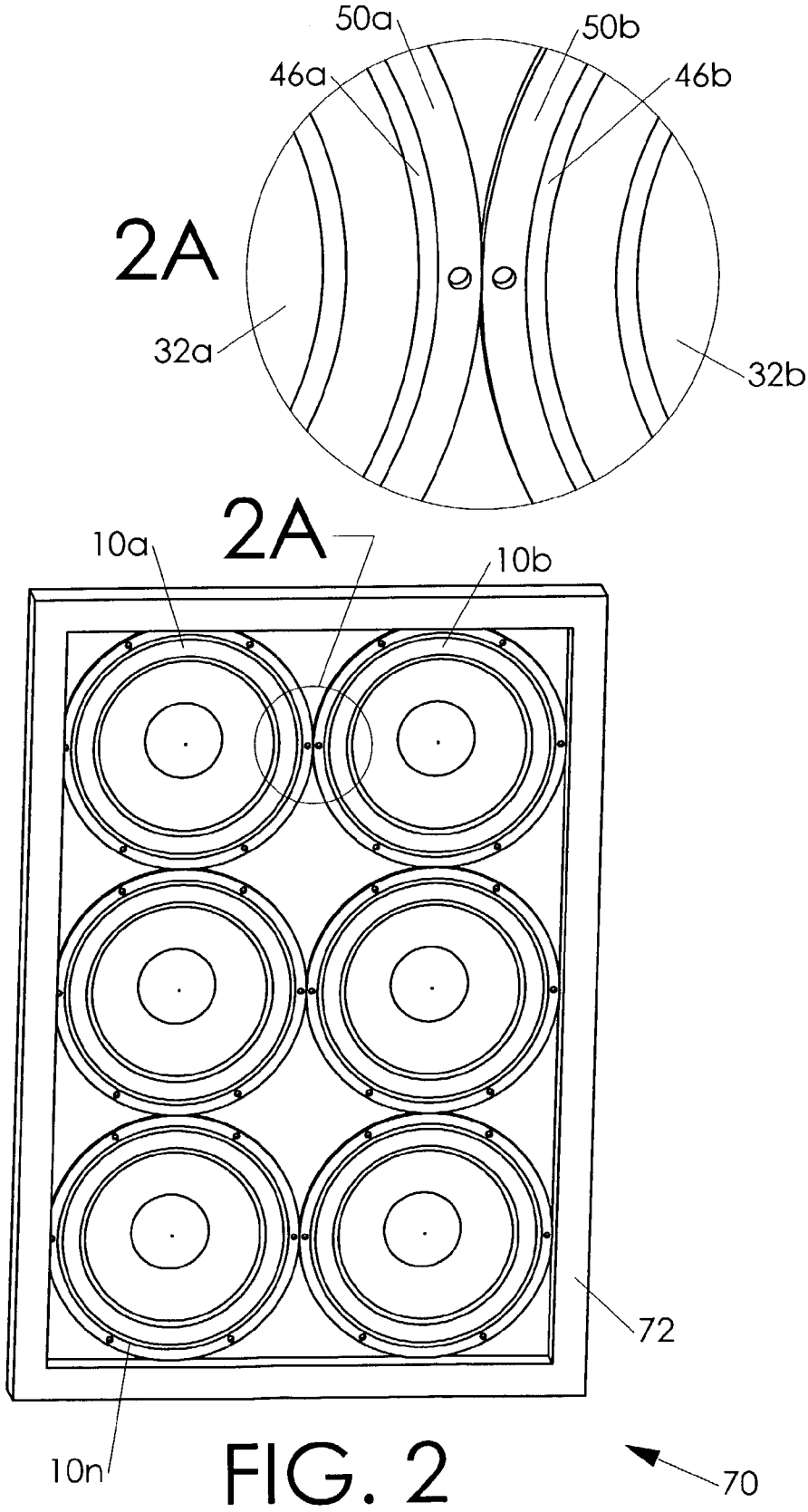
FIG. 2 shows, in perspective view, a multi-speaker baffle assembly according to the prior art.

FIG. 3 illustrates one embodiment of a speaker 100 according to this invention. The speaker includes an improved frame or basket 102 coupling a diaphragm assembly to a motor structure. The frame includes a base 104 for coupling to the motor structure, a mounting flange 108, and a connecting structure 106 extending generally outward and upward from the base to support the mounting flange. The base may comprise a flat plate, as shown, or it may have any other suitable shape, according to the needs of the application at hand, such as a cylinder for coupling to the outside of an internal magnet motor structure cup. The connecting structure 106 may be in the form of ribs or legs, for ventilation, or they may be an unvented cup-like structure.

The mounting flange includes tab portions 110 which extend outward to provide support for mounting the speaker and to provide adequate clearance for the mounting holes 112. The mounting flange also includes non-tab portions 114 which do not extend outward any significant distance, only enough to form a seal with the baffle to which it is mounted and to have sufficient thickness of frame material to provide structural integrity. The outer perimeter of the diaphragm is suspended from the mounting flange of the frame by an improved surround 120.

As seen in the detail view 3A, the mounting flange includes a generally axially-aligned groove 128 which mates with a generally axially-aligned outer portion 126 of the surround 120. The surround thus is lacking a conventional outer glue-joint flat portion which would need to extend a significant distance outward beyond where the groove 128 is. The surround is shown as including a conventional glue-joint inner flat portion 124 which mates with the conventional diaphragm, however it could alternatively use a coupling mechanism similar to the groove 128 if desired. The non-coupled middle portion 122 of the surround provides the suspension action of the surround.

In some embodiments, a complete groove 128 is not necessary, and the mounting flange includes only a raised lip 129. The surround is overlapped over the lip, and glued or otherwise coupled in place. Whether in the form of a groove, a lip, or other geometric configuration, these may be collectively termed mounting surfaces which are substantially radially aligned.

The radial fins on the outer surface of the frame's mounting flange are for aesthetic purposes and to improve thermal transfer by increasing the surface area of the basket, and are not necessary, but gives an added benefit from the use of the non-circular frame of this invention.

Figure 4:
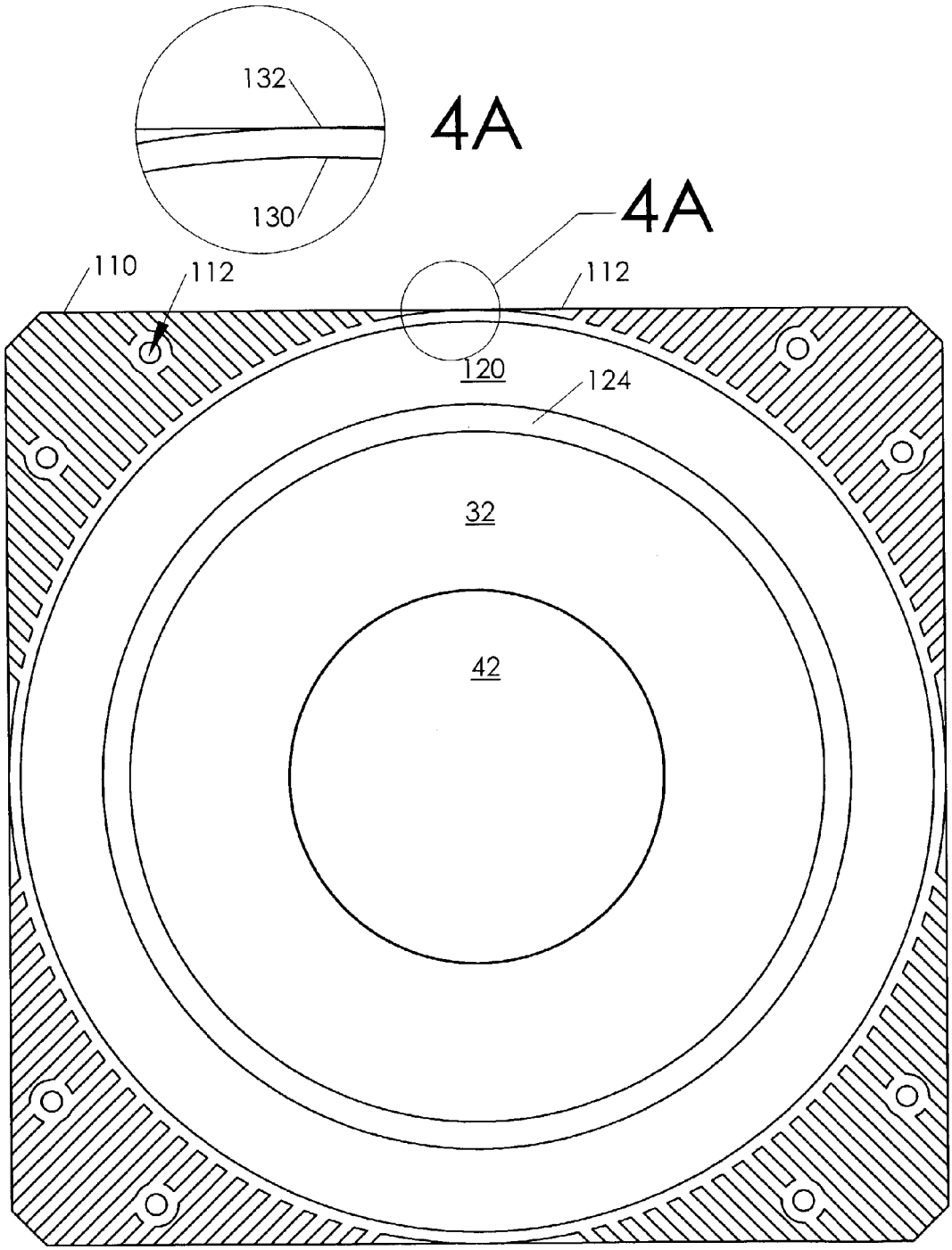
FIG. 4 shows, in axial view with a detail view, the speaker of FIG. 3.

FIG. 4 illustrates the speaker 100 as viewed axially from the top. The diaphragm 32 and dust cap 42 are visible, as are the suspension portion 120 and inner glue joint portion 124 of the surround. The frame's tabbed 110 and non-tabbed 114 portions are visible, as are the mounting holes 112 which extend through the tabs 110. The detail view 4A illustrates that the outermost face 130 of the axially-aligned outer lip 126 of the suspension can be in extremely close proximity to the outermost edge 132 of the non-tabbed portions of the frame.

This dimension may be on the order of ¼ or less than that which would be required in the prior art to accommodate a radially-extending outer glue joint flat portion of the surround. This allows multiple drivers with a given effective piston radiating area (SD) to be packed much closer together, or, stated another way, drivers with a given overall width to have a significantly larger SD, without sacrificing the maximum excursion capability of the suspension.

In one embodiment, the outer perimeter of the frame's mounting flange may be substantially square, to facilitate an advantageous adjacent packing of speakers.

Figure 5:
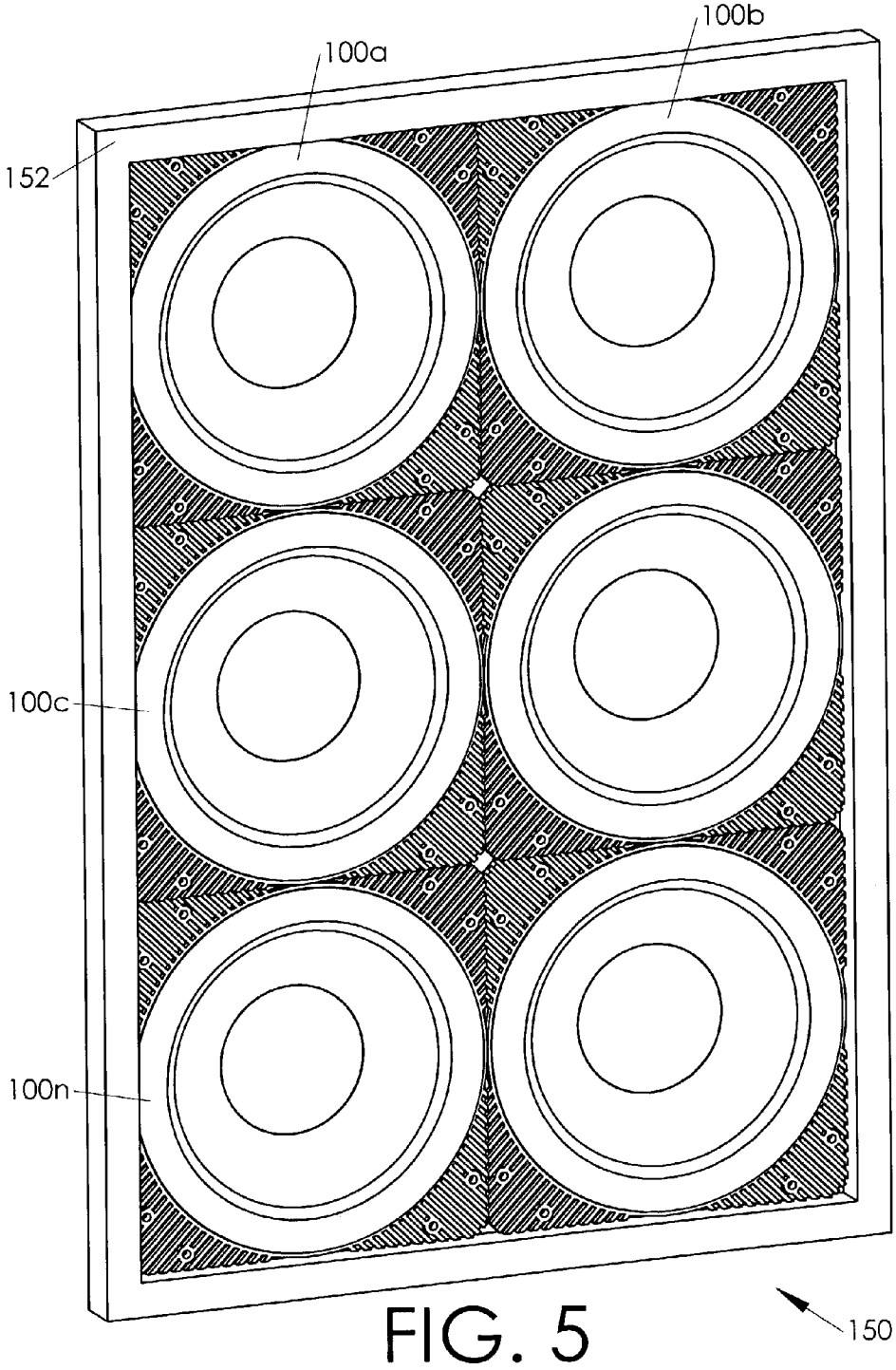
FIG. 5 shows, in perspective view, a multi-speaker baffle assembly according to this invention, using the speaker of FIGS. 3 and 4.

FIG. 5 illustrates one embodiment of a multi-speaker assembly 150 taking advantage of this invention. The assembly includes a speaker cabinet or baffle 152 to which are coupled a plurality of speakers 100*a–n* such as those of FIG. 4. In some embodiments, the speakers may be placed into extremely close proximity, or even butted against each other's outer edges, as shown. As can be seen, the lack of the surrounds' outer radial glue joint portions allows a significantly closer center-to-center spacing of the speakers, as two such portions are eliminated between each adjacent pair of speakers. As can further be seen, the non-tabbed portions of the frame further enable tight packing, as the mounting holes are moved to positions which are not in the critical adjacent dimensions.

In some embodiments, the distance between the suspending middle portions of the surrounds of an adjacent speaker pair, as measured over the non-tabbed portions of their respective frames, is less than half the radial dimension of one of the suspending middle portions. From surround OD to surround OD of adjacent drivers, it is possible to achieve a spacing as low as 4–6 mm, although, at such a tight spacing, it would be advisable to provide additional structural support to the baffle in the region directly below this spacing.

Figure 6:
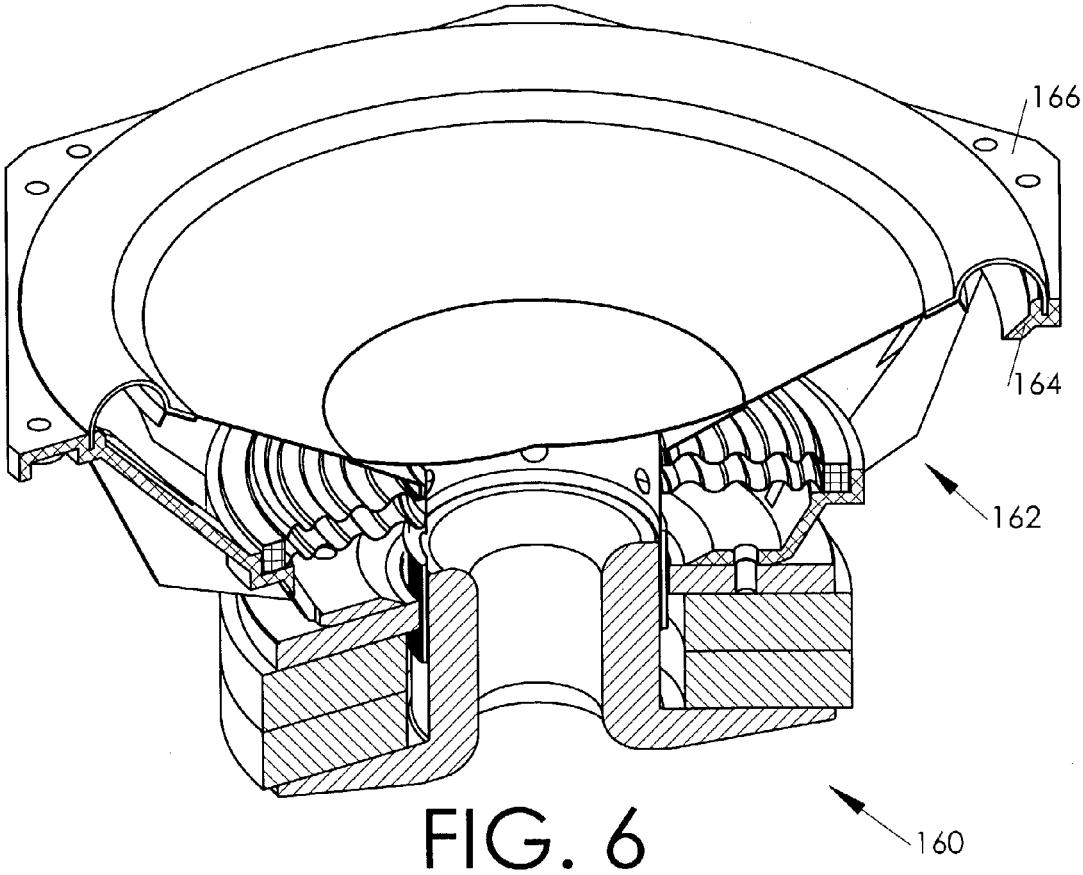
FIG. 6 shows, in perspective view with a partial cutaway, another embodiment of a speaker having the improved surround and another embodiment of a frame according to this invention.

FIG. 6 illustrates another embodiment of a speaker 160 according to this invention. The speaker is similar to that described above, except that the mounting flange of its frame 162 has a hexagonal shape rather than square. The hexagonal shape includes six non-tabbed portions 164 where the surround extends very nearly to the perimeter of the speaker, and six tabbed portions 166 which provide mounting surface and clearance for the mounting holes.

Figure 7:
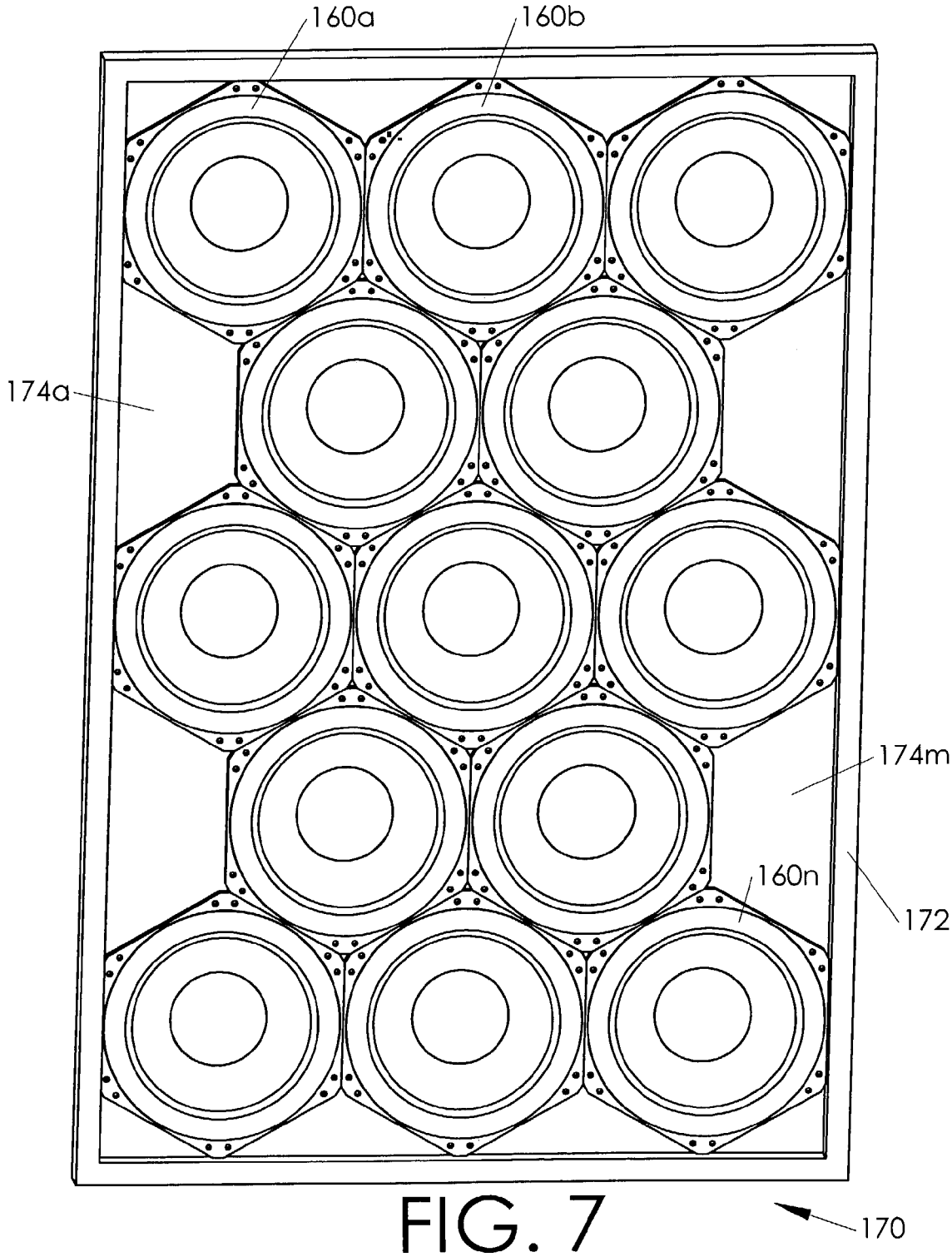
FIG. 7 shows, in perspective view, another multi-speaker cabinet assembly according to this invention, using the speaker of FIG. 6.

FIG. 7 illustrates one embodiment of a multi-speaker assembly 170 including a cabinet or baffle 172 and a plurality of speakers 160*a–n*, and demonstrates the maximally effective packing enabled by the hexagonal shape. Regions 174*a–m* can advantageously be used for port openings (not shown) in a vented box configuration.

Other speaker basket shapes may certainly be used, but may provide less effective packing than hexagonal or square speakers. Other shapes which provide tight packing factors include triangular, rectangular, and trapezoidal.

The invention enables a speaker to be placed in closer radial proximity to any other object, not only to other similar speakers. For example, a single speaker may be put into a radially smaller front baffle of an enclosure than would be possible if clearance were needed for a radially-extending outer surround glue joint flat portion, and/or for a complete perimeter flange, as in the prior art.

The diaphragm is not necessarily round or axisymmetric, and could be, for example, oval shaped, square, hexagonal, octagonal, or the like. For instance, a 12-sided polygon diaphragm would be particularly well-suited to be combined with a hexagonal frame. It is not necessarily the case that the surround have an identical cross-sectional shape at all radial sections. In some embodiments, the surround may not even use the same outer attachment mechanism (e.g. the groove illustrated above) at all radial locations.

FIG. 8 and its detail view 8A illustrate another embodiment of a speaker 180 according to this invention. The speaker includes a diaphragm 120 which is coupled to the outer mounting flange 182 of the frame by a hold-down ring 184. The hold-down ring may, in one embodiment, have a shape which is generally a sideways T, as shown. The frame includes a groove 186 which may, optionally, have a slightly beveled shape such that it is wider at its external opening than at its floor. The generally axially-aligned outer portion 126 of the surround extends into the groove.

The hold-down ring includes a generally axially-aligned pinch wedge 188 which extends into the groove to pinch the surround against the side wall of the groove. The pinch flange may optionally have a beveled shape such that it is narrower at its end than at its base, as shown. The hold-down ring may further include a radially-extending mounting portion 190 by which the hold-down ring is coupled to the frame (as shown) or, alternatively, to the baffle (not shown). The mounting portion may include tabbed regions 192 which extend outward to provide clearance for mounting bolts or the like. The hold-down ring may optionally include a generally axially-aligned extension 194 which provides additional axial height to the hold-down ring. This stiffens the hold-down ring by providing a lengthened bending moment, in order to distribute the hold-down force more evenly, especially in the non-tabbed regions of the frame and hold-down ring where there is no room for hold-down bolts.

Figure 9:
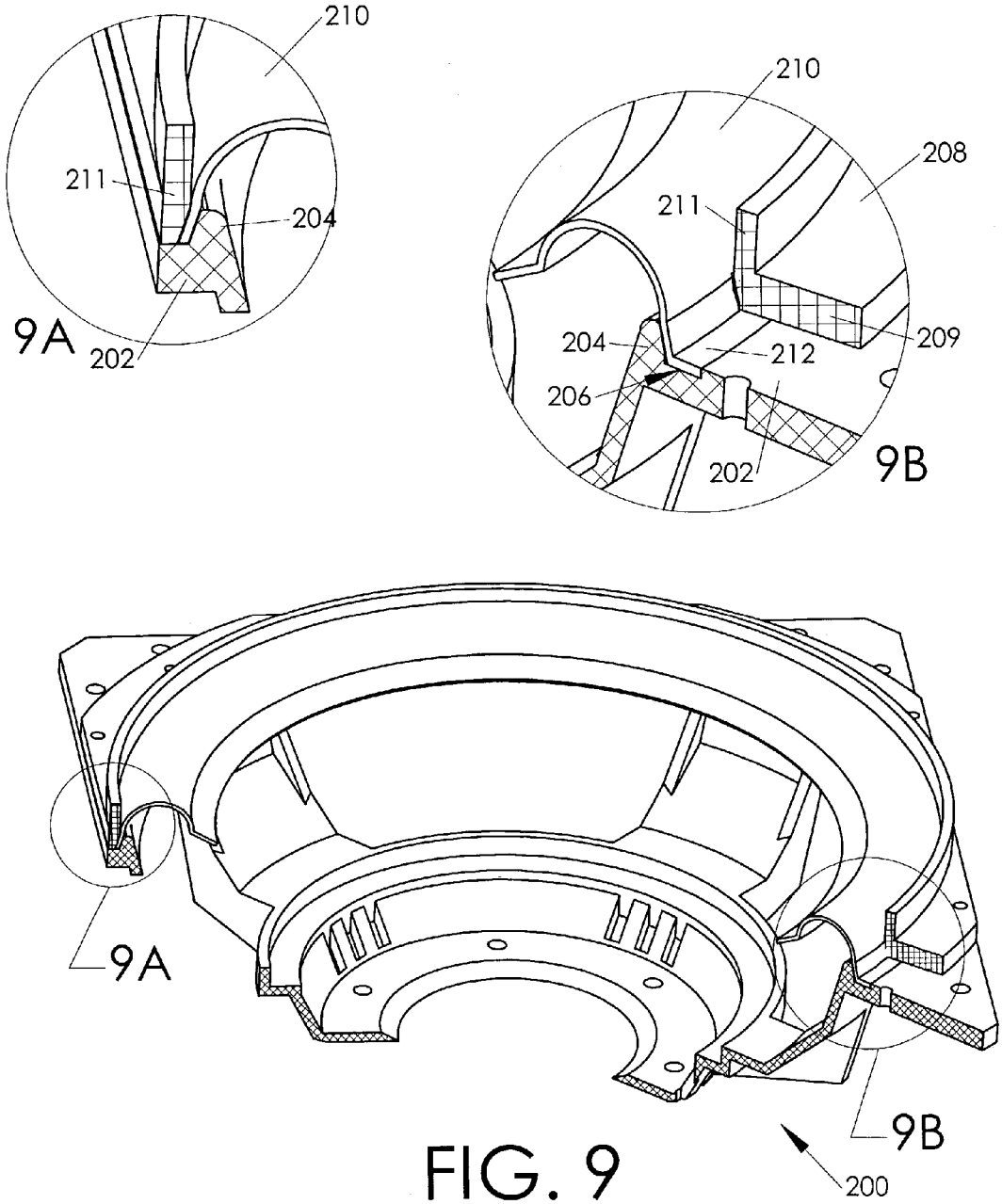

FIG. 9 and its detail views 9A and 9B illustrate a frame and suspension assembly 200 according to another embodiment of this invention. The mounting flange 202 of the frame has a lip 204 with a generally axial outer face. The generally axial outer rim of the surround 210 is pinched against the lip by an L-shaped hold-down ring 208 which includes a radially-extending portion 209 and an axially-extending portion 211. The axially-extending portion 211 comprises the pinch wedge and may extend around the entire hold-down ring, while the radially-extending portion may extend all the way around or, as illustrated, it may be truncated or non-existent in the non-tabbed regions of the frame, to minimize the distance from the diaphragm to the outer dimension of the speaker.

In the 9B detail view, the hold-down ring has been cross-sectioned with a different cutaway angle than the other components, for better visibility of an optional radial segment 212 of the surround which fits into a channel 206 formed into the surface of the mounting flange of the frame.

Figure 10:
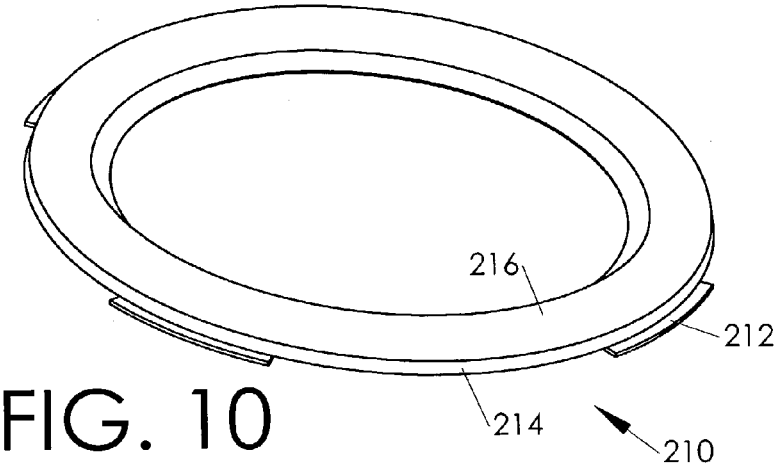
FIGS. 9 and 10 show alternative embodiments of the frame, surround, and hold-down ring of the invention.

FIG. 10 illustrates the surround 210 in further detail. The surround includes radial segments 212 which correspond to the radially-aligned glue-joint flat outer portions of a conventional surround, except that these segments do not extend around the entire circumference of the surround. Rather, the radial segments are interrupted by portions of the surround whose outer edge comprises only the generally axially-aligned outer rim 214 of the surround. As seen in FIG. 9, the radial segments 212 may be employed in the tabbed regions of the frame's mounting flange, while the axial sections 214 may be employed in the non-tabbed regions of the frame's mounting flange. This configuration provides some measure of the surround attachment mechanism of the prior art, without sacrificing the spacing and diaphragm size advantages of the present invention.

CONCLUSION

The various features illustrated in the figures may be combined in many ways, and should not be interpreted as though limited to the specific embodiments in which they were explained and shown.

While the invention has been described with reference to embodiments of an audio loudspeaker, those skilled in the art will readily appreciate that the invention may be embodied as a microphone, or any other transducer which has an oscillating diaphragm. While the invention has been described with reference to a motor structure which provides motive force to a diaphragm assembly, those skilled in the art will readily appreciate that when the diaphragm is externally driven by acoustic energy, the motor structure functions as a generator, producing electrical signals representative of the received acoustic waves. And, while the invention has been described in terms of an electromagnetic motor structure, those skilled in the art will readily recognize that alternative motor or generator means may be employed in conjunction with the invention, such as piezo electric structures or electrostatic structures. Furthermore, while the invention has been described with reference to transducers which include motor structures, it may also be used in e.g. a passive radiator which includes a diaphragm, a frame, and a suspension, but no motor structure.

While the invention has been described with reference to a particular suspension component in the form of a flexible rubber surround which is the outermost suspension component in the speaker, the skilled reader will readily appreciate that the same principles may be applied to other suspension components, such as a spider. A spider may have an axial outer perimeter coupled to an axial mounting surface, to reduce the overall dimension of the frame at that location, or to facilitate the use of a larger spider within a given outer frame dimension. In the case of a spider or other suspension component which is not the outermost, and which may typically be coupled not directly to the diaphragm but to another diaphragm assembly component such as the bobbin, the mounting flange in question will be the frame structure at which the suspension component is mounted, rather than the outermost mounting flange at which the diaphragm's surround is coupled. The suspension component has been illustrated as having a half-roll shape, but could, in other embodiments, have any other suitable suspension shape, such as the accordion shape which is commonly used in spiders. The suspension component has been illustrated as having a generally radially-extending inner portion for flat gluing to the front surface of the diaphragm, but could, in other embodiments, have any other suitable configuration or attachment means. For example, it may have a generally axial orientation.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An acoustical transducer comprising:

(A) a frame including, (a) a base for coupling to a motor structure, (b) a mounting flange including a substantially axially-aligned mounting surface including an outward face, (c) a connecting structure coupling the base to the mounting flange;

(d) non-tabbed portions which extend radially beyond the mounting surface to form a seal with a baffle to which the acoustical transducer may be mounted; and (e) tabbed portions radially extending axially beyond the mounting surface to form a surface through which bolts can be inserted to mount the acoustical transducer to the baffle; and (B) a suspension component including, (a) an inner portion for coupling to a diaphragm assembly, (b) a middle portion providing suspension for the diaphragm assembly, and (c) a substantially axially-aligned outer portion coupled to the outward face of the mounting surface.

2. The acoustical transducer of claim 1 further comprising:

a hold-down ring coupled to the mounting flange and holding the outer portion of the suspension component in position against the outward face of the mounting surface of the mounting flange, with the hold-down ring being positioned outside the outer portion of the surround.

3. The acoustical transducer of claim 2 wherein:

the hold-down ring has a substantially L shape including a segment which extends radially for coupling to the mounting flange, and a segment which extends axially to stiffen the hold-down ring.

4. The acoustical transducer of claim 1 wherein:

the tabbed portions include mounting holes for mounting the acoustical transducer; and the non-tabbed portions do not include mounting holes.

5. The acoustical transducer of claim 1 wherein:

the mounting flange of the frame has a substantially square shape.

6. The acoustical transducer of claim 1 wherein:

the mounting flange of the frame has a substantially hexagonal shape.

7. The acoustical transducer of claim 1 wherein:

the mounting flange of the frame further comprises a plurality of radially-extending channels disposed at the tabbed portions; and the suspension component further comprises a plurality of radially-extending segments each disposed within a respective one of the radially-extending channels.

8. The acoustical transducer of claim 1 wherein:

the suspension component comprises a surround, and the middle portion of the surround comprises a half-roll.

9. The acoustical transducer of claim 1 wherein:

the suspension component comprises a surround, and the middle portion of the surround comprises an accordion shape.

10. The acoustical transducer of claim 1 wherein:

the suspension component comprises a spider.

11. The acoustical transducer of claim 1 wherein:

the suspension component comprises a surround;

the acoustical transducer further includes a diaphragm coupled to the suspension component and a motor coupled to the diaphragm; and further comprising a plurality of such acoustical transducers coupled together into an assembly in which a distance between the suspending middle portions of the surrounds of an adjacent sneaker pair, as measured over the non-tabbed portions of their respective frames, is less than half a radial dimension of one of the suspending middle portions.

12. The assembly of claim 11 wherein:

the frame of each acoustical transducer of the plurality has a substantially square perimeter shape.

13. The assembly of claim 12 wherein the diaphragm and surround of each of the plurality of transducers has a substantially rounded shape, wherein corners of the frame which extend beyond the rounded surround form the tabbed portions for coupling the transducer to the assembly.

14. The assembly of claim 11 wherein:

the frame of each acoustical transducer of the plurality has a substantially hexagonal perimeter shape.

15. The assembly of claim 14 wherein the diaphragm and surround of each of the plurality of transducers has a substantially rounded shape, wherein corners of the frame which extend beyond the rounded surround form the tabbed portions for coupling the transducer to the assembly.

16. The acoustical transducer of claim 1 further comprising:

the motor structure coupled to the base of the frame;

the diaphragm assembly coupled to the inner portion of the suspension component and including a voice coil disposed within die motor structure.

17. The acoustic transducer of claim 16 configured as an audio loudspeaker.

18. The acoustic transducer of claim 16 configured as a microphone.

19. The acoustic transducer of claim 1 configured as a passive radiator.

20. A frame for use in coupling an acoustical transducer motor structure to a diaphragm assembly, the diaphragm assembly including a surround having an outer perimeter that extends substantially axially, the frame comprising:

a base for coupling to the motor structure;

a mounting flange far supporting the diaphragm assembly;

a connecting structure coupling the mounting flange to the base;

a substantially axially-aligned mounting surface dimensioned to accept the outer perimeter of the surround on an outer face of the mounting surface;

tabbed portions of an outer perimeter of the mounting flange which extend radially outward beyond the mounting surface to facilitate mounting of the frame to a baffle; and non-tabbed portions of the outer perimeter of the mounting flange.

21. The frame of claim 20 further comprising:

a radially-extending channel in each of the tabbed portions, for holding a radial segment of the surround.

22. An acoustical transducer comprising:

(A) a frame including, (a) a base for coupling to a motor structure, (b) a mounting flange including groove, wherein an inner side of the groove comprises a substantially axially-aligned mounting surface, and (c) a connecting structure coupling the base to the mounting flange; and (B) a suspension component including, (a) an inner portion for coupling to a diaphragm assembly, (b) a middle portion providing suspension for the diaphragm assembly, and (c) a substantially axially-aligned outer portion coupled to the mounting surface; and (C) a hold-down ring coupled to the mounting flange and holding the outer portion of the suspension component m position against the mounting surface of the mounting flange, the hold-down ring having a substantially T shape including a first segment which extends axially into the groove, a second segment which extends radially for coupling to the mounting flange, and a third segment which extends axially to stiffen the hold-down ring.

* * * * *